US007792782B2

(12) United States Patent
Yun

(10) Patent No.: US 7,792,782 B2
(45) Date of Patent: Sep. 7, 2010

(54) INTERNET MUSIC COMPOSITION APPLICATION WITH PATTERN-COMBINATION METHOD

(75) Inventor: Hyeong-Sik Yun, Gyeonggi-Do (KR)

(73) Assignee: Silentmusicband Corp. (KR)

( * ) Notice: Subject to any disclaimer, the term of this patent is extended or adjusted under 35 U.S.C. 154(b) by 336 days.

(21) Appl. No.: 11/912,317

(22) PCT Filed: May 1, 2006

(86) PCT No.: PCT/KR2006/001628

§ 371 (c)(1),
(2), (4) Date: Oct. 23, 2007

(87) PCT Pub. No.: WO2006/118405

PCT Pub. Date: Nov. 9, 2006

(65) Prior Publication Data

US 2008/0215599 A1 Sep. 4, 2008

(30) Foreign Application Priority Data

May 2, 2005 (KR) ..... 10-2005-0036825

(51) Int. Cl.
*G06F 17/00* (2006.01)

(52) U.S. Cl. ..... 707/104.1; 707/100; 707/101; 707/102

(58) Field of Classification Search ..... 707/104.1, 707/100–102
See application file for complete search history.

(56) References Cited

U.S. PATENT DOCUMENTS 7,081,579 B2 * 7/2006 Alcalde et al. ..... 84/608
7,164,076 B2 * 1/2007 McHale et al. ..... 84/616

FOREIGN PATENT DOCUMENTS

KR 2000-58995 A 10/2000
KR 2001-97614 A 11/2001
KR 2001-111126 A 12/2001
KR 2005-3911 A 1/2005
KR 2005-13351 A 2/2005

OTHER PUBLICATIONS

International Search Report for corresponding International Application N. PCT/KR2006/001628 dated May 19, 2006.

* cited by examiner

*Primary Examiner*—Sana Al-Hashemi
(74) *Attorney, Agent, or Firm*—Cantor Colburn LLP

(57) ABSTRACT

This invention relates to the method and system of producing/composing user's own music (musical composition, arrangement, and performance) on the web site. The system creates musical patterns out of all kinds of music, recommends the ideal patterns in accordance with genres selected by users, and ultimately enables ordinary internet users without musical knowledge to compose their own music simply by selecting and assembling the patterns. The system of invention is composed of a DB server including a music database storing a music data specifically patterned from a plurality of music and a lyrics database storing lyrics data patterned from a plurality of lyrics and various kinds of texts; an user PC for downloading the music and lyrics data through a music file real-time player; a web site; and a music pattern automatic control server for controlling the files suitable for music by allowing the user to select and combine the patterned music and lyrics data of the said DB server in accordance with acoustics and harmonics.

3 Claims, 5 Drawing Sheets

[Fig. 1]
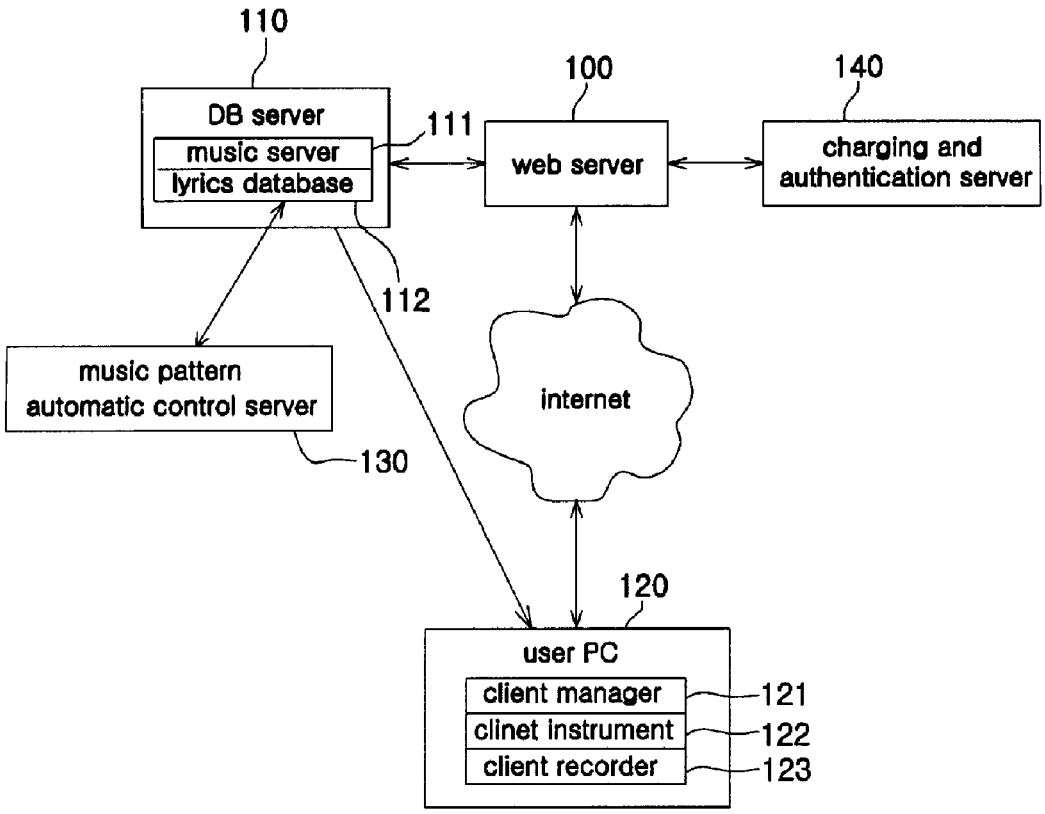

[Fig. 2]
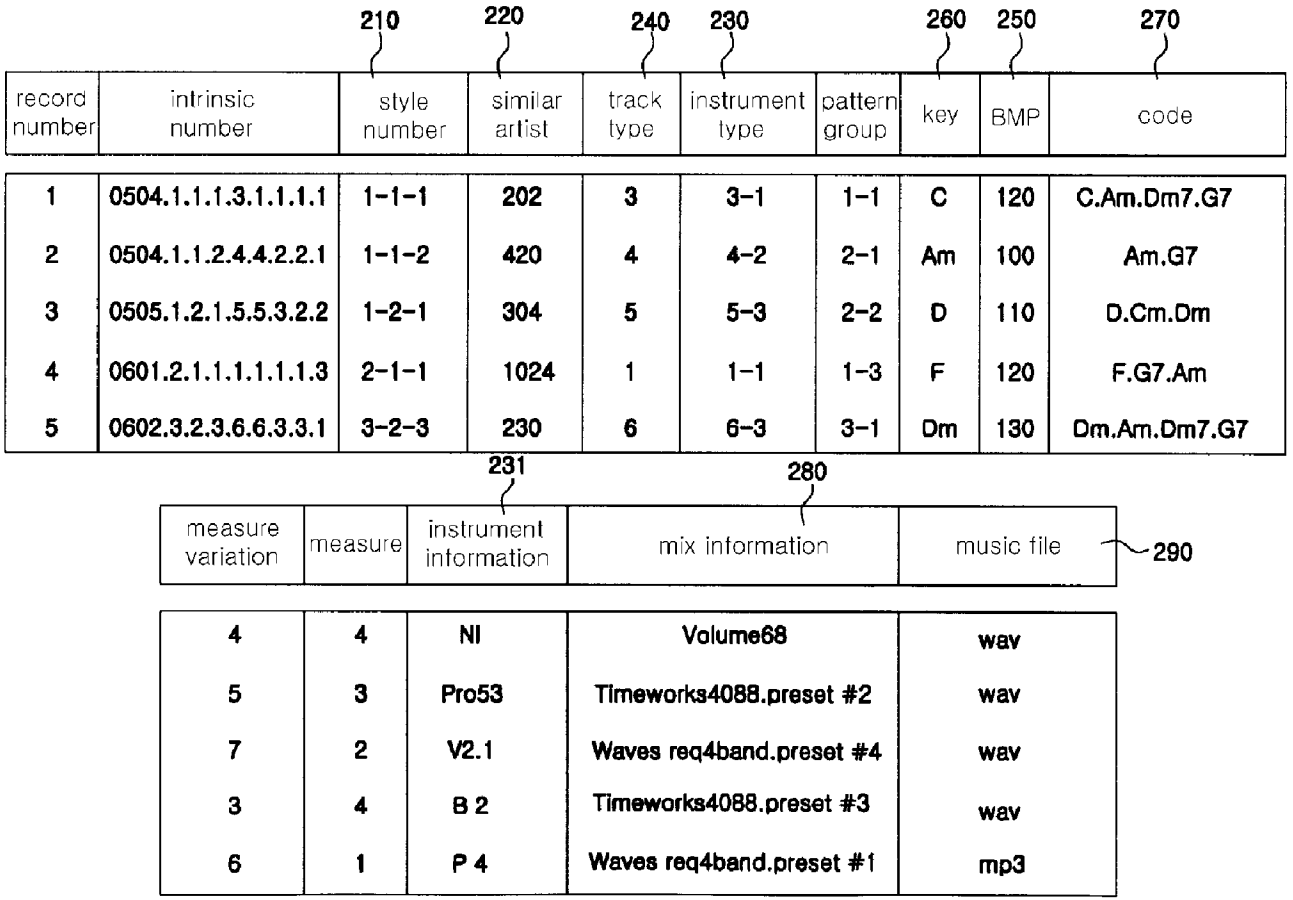

[Fig. 3]
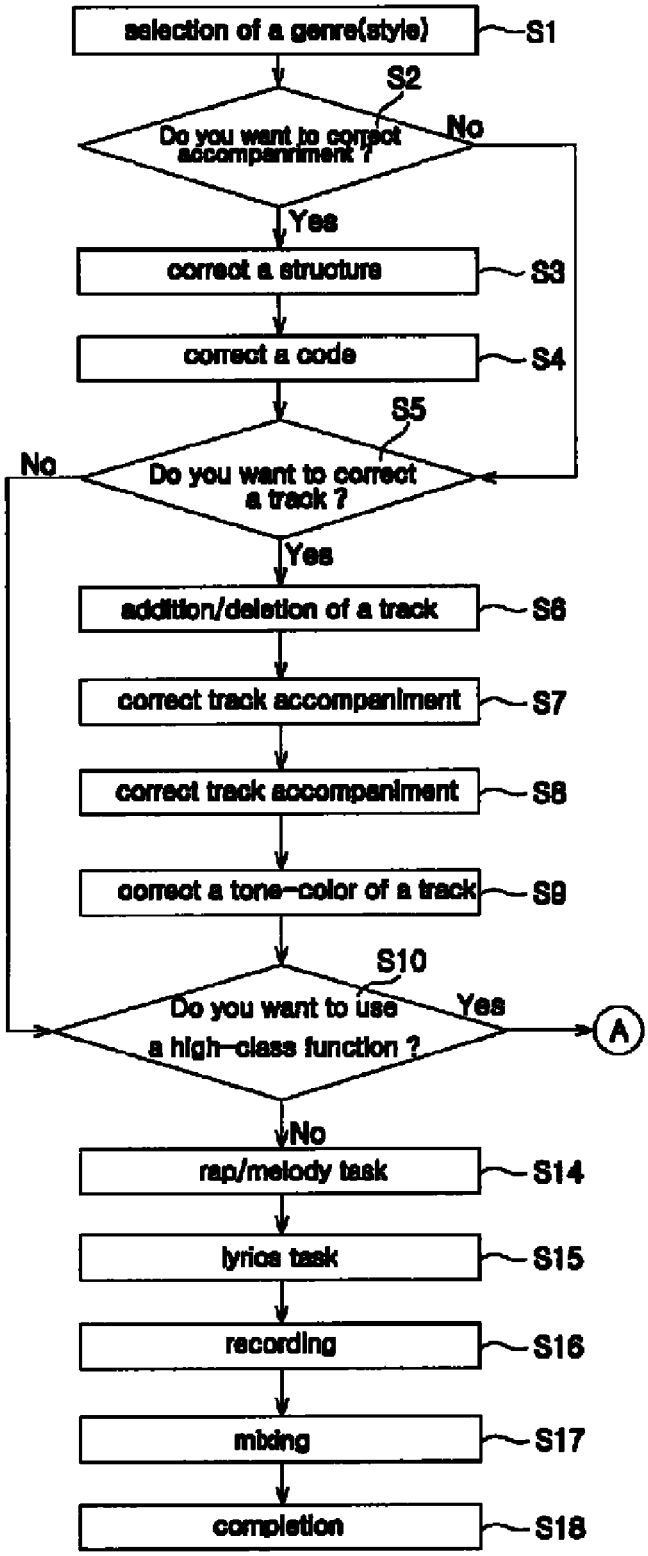

[Fig. 4]
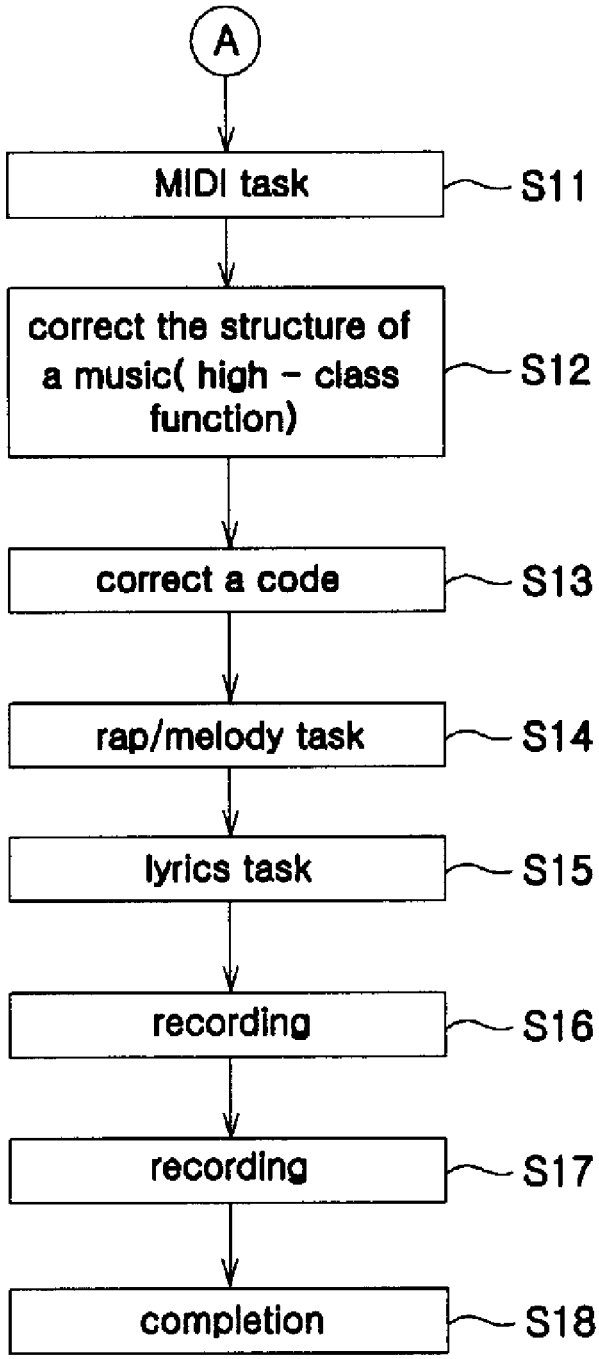

[Fig. 5]
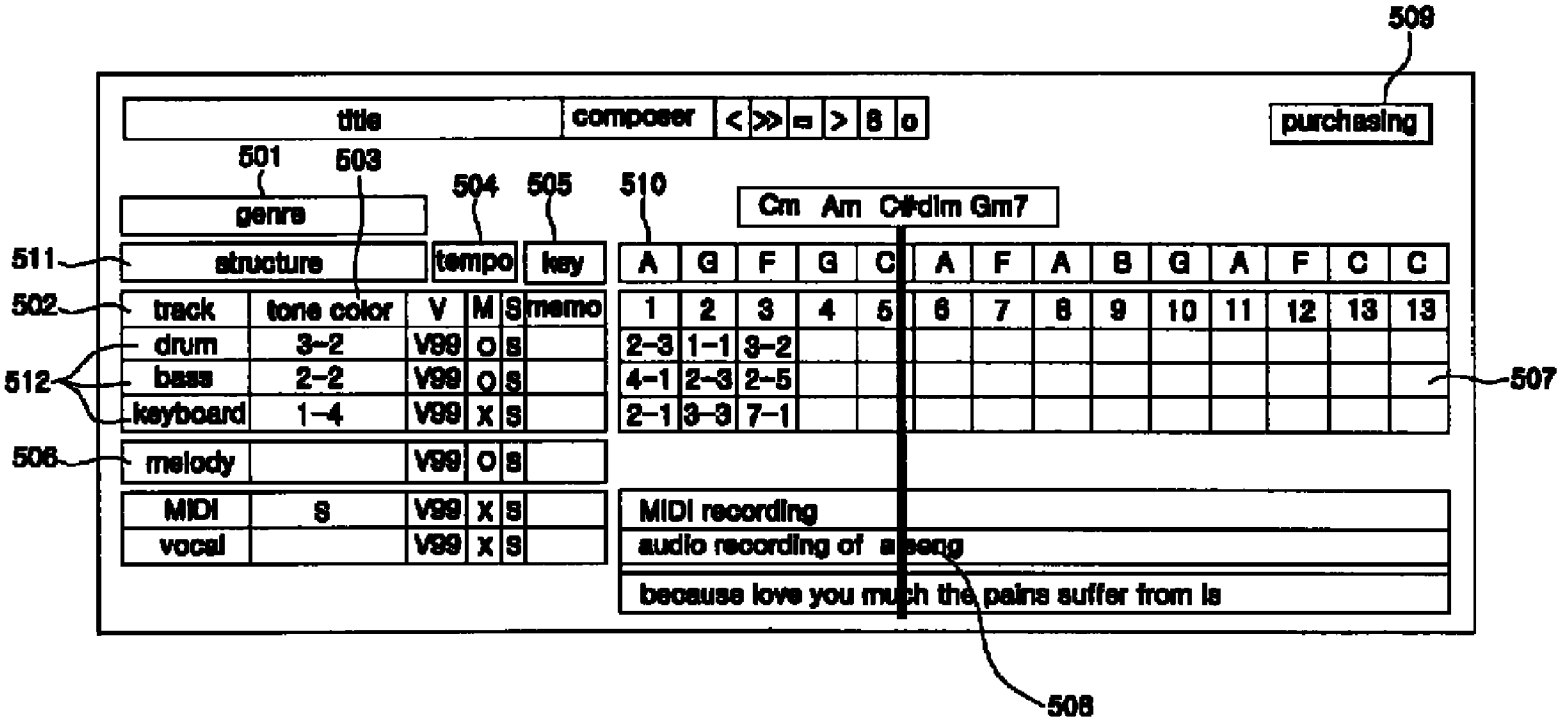

INTERNET MUSIC COMPOSITION APPLICATION WITH PATTERN-COMBINATION METHOD

TECHNICAL FIELD

This invention relates to the system and method of music composition, arrangement, and performance on the web site. The system creates musical patterns out of all kinds of music, recommends the ideal patterns in accordance with genres selected by users, and ultimately enables ordinary internet users without musical knowledge to compose their own music simply by selecting and assembling the patterns.

BACKGROUND ART

With the conventional composition method, a composer has to write on the music sheet or with the computer program while playing a familiar instrument, and then replay the written music for correction. Using the sample CDs of pre-recorded rhythm with various instruments is also another method of composition and arrangement. The above method is so difficult for ordinary people with no musical expertise that only professional musicians can utilize it, which also requires much cost, time, and efforts.

DISCLOSURE OF INVENTION

Technical Solution

This invention is to eliminate the above-mentioned problem by making patterns of various genres of music, storing into a database, and combining the patterned data in accordance with diverse harmonistic and acoustic theories.

The ordinary users without musical knowledge can easily compose, arrange, and perform high quality music by assembling the patterns this invention system recommends. Furthermore they can write lyrics with reference to the selections of contents classified by various subjects and applications.

Accordingly, this invention enables the ordinary users to produce their individual unique music album instead of relying on professional musicians. Besides, it offers a variety of service levels from beginner mode with automatic composition function to professional mode with advanced editing functions.

Advantageous Effects

In the past, the musical compositions and the arrangements were made by only those who have special knowledge about music, but thanks to this invention, it becomes possible for the ordinary people having interest in music to compose his/her desired music without any difficulties.

Furthermore, since it becomes possible to compose music with his/her own PC through the Internet, the advantage of this invention is that it remarkably cut down the expenses of music production, and is totally free from time and space restrictions.

Finally, by using this invention, various changes and modifications can be made within the scope of the structure.

BRIEF DESCRIPTION OF THE DRAWINGS

FIG. 1 is the system structure of the invention.

FIG. 2 is an example of database of the invention.

FIG. 3 is the system flow chart of music composition utilizing the invention.

FIG. 4 is the system flow chart in the event of professional mode.

FIG. 5 is the user interface of music composition with the invention.

BEST MODE FOR CARRYING OUT THE INVENTION

The system of invention, designed for the above objects, is composed of;

a DB Server comprising the database of music patterns classified by genres, artists, and ages, and the database of lyrics patterns sampled from various lyrics and texts, an User PC for downloading the music and lyrics data through a music file real-time player, a Web Server storing a web site and various kinds of user information, and managing communication between the user computer and the DB server, and a Music Pattern Automatic Control Server which controls the files suitable for music by combining the user-selecting music and lyrics data in accordance with acoustics and harmonics.

Mode for the Invention

Below is the practical example of the invention explained in detail with the attached figures.

FIG. 1 is the overall system structure of music composition service making use of the patterned data of the invention. This music composition system is composed of a web server (100), a DB server (110), a music pattern automatic control server (130), a charging/authentication server (140), and a user PC (120).

The DB server (110) stores music database (111) of patterned data from various kinds of music, lyrics database (112) of various patterned lyrics and texts, and other related information.

The user PC (120) is composed of a client manager (121) which allows an user to input the desired information and to listen to the composed music, a client instrument (122), a software instrument operated by inputs of midi instrument for an user to perform the professional functions such as code correction and structure modification, and a client recorder (123) for recording the user's voice or sounds of an instrument except the above client's instruments. The user PC (120) downloads the patterned data stored in the DB server through a music file real-time player in the PC (120).

The web server (100) which executes the communication between the user PC (120) and the DB server (110) stores the user information, the web site data, and the music data files composed by the user, and instructs the DB server (110) to send the related music files to the user upon request.

The music pattern automatic control server (130) is fitted with an artificial intelligence music pattern automatic presentation system using the patterning algorithm based on the casual relations of various kinds of famous arrangements which is used in harmonics, acoustics, and performance, and enables the right patterned data to be transmitted to the music which is being composed in the user PC (120).

While communicating between the user PC (110) and the web server (100), the charging/authentication server (140) supports the payment transactions on the diverse kinds of services requested by the users, linking the music composed by a user to the homepage on the Internet, or downloading the music to the user PC (120).

FIG. 2 shows the structure of database storing the patterned data of the invention.

Style number (210) data, the genre (style) of music which a user wants to create, is divided into the large, middle, and small category.

The large category is classified into ballad, rock ballad, R&B ballad, house dance, Latin dance, beach dance, trance, hip-hop, techno dance, heavy metal, trash metal, and so on. The middle category is classified into keyboard R&B ballad, piano ballad, and so on. The small category is variations of music with similar atmospheres. A number is allocated to each classification.

As for similar artist (220), a number is assigned and stored to each artist (for example, Kim Bum Soo-1, Cho Sung Mo-2, Loveholic-3 . . . ).

Instrument type (230) is divided into the large and small category. The large category is classified into drum, percussion, sound effect, keyboard, organ, guitar, string, reed, synthesizer, and so on. The small category subdivides the classified instruments; for example, subdivided into percussion-808-drum with identification number for storing.

As for track type (240), an instrument and sound effect is designated for each track (1-drum/percussion, 2-base, 3-keyboard, . . . 9-sound effect, 10-rap, 11-vocal . . . ).

In addition, BPM (250), beats per minute, can set the speed of entire music.

Key (260) designates the key of whole music.

Code (270) stores each musical pattern data after being classified by the code progressions.

Instrument information (231) classifies the distinctive information of the instruments, since the same instruments have a bit different features according to the manufacturers.

Mix information (280) stores the parameter value of each pattern data.

Music file (290) can store the conventional types such as wave, midi, rm, MP3, MP4, vfg, etc., or other changed types using an additional proper music conversion program.

Below is the explanation of compositional procedures making use of the invention with the above structure.

FIG. 3 is the operational flow chart of music composition making use of the invention system.

First of all, at the step S1, a user selects a genre (style) of music to create. Tunes with the styles related to large category—small category—variation in the database of FIG. 2 are presented. Once the user selects a desired style after listening to the tune, a piece of music is composed automatically and randomly. A basic track is also generated, and a complete piece of music (for example, prelude—introduction—repetition of introduction—connection part—climax—interlude—connection part—climax—repetition climax—postlude) is composed. Generally, large category contains genres, and small category subdivides the genres into more specific styles; for instance, a mood of particular music of a specific artist. Variation transforms music with similar atmosphere. In this way, it becomes possible for the user to complete most parts of the composition by simply selecting the styles thanks to these subdivided styles.

At the step S2, after listening to the completed music (accompaniment), the user decides whether to modify or not; going to Step S3 for modification, otherwise jumping to step S5.

The step S3 is for selecting the structure of music. For example, the structure of ballad is as follows; prelude—introduction—repetition of introduction—connection part—climax—interlude—connection part—climax—repetition of climax—postlude. Since each part has 1-16 measures, and the same parts repeat in a music, practical composing parts are limited when a user composes music. It is possible for a user to make easy modification into the desired structure because a plurality of structures are presented. The user can modify the structure any time, as only the structure is changed when the composed contents remain unchanged. In addition, since each style has a different structure list, it is possible to make wide-ranging modification covering the structures of all existing music.

The step S4 is for modifying the code of music. The code is the most important element for constituting the base of music, and it is quite difficult for an ordinary user to compose music due to the code progression changed more than 10 times in a measure. Therefore, in this invention, the concept of the style and structure are introduced so that a general user may do the code progression of music. At this code modification step, the code progression is modified on each of the structure groups subdivided out of the structure of a music, that is, once a code of climax is modified, whole climax parts of the music are changed at the same time (for example, C-Am-Dm-G7 - - - > C-C/B-Am-Am/G-F-G7).

At the step S5, the user decides whether the track of the completed accompaniment to be modified or not; moving to the step S6 for modification, otherwise jumping to the step S9.

The step S6 is for adding or deleting tracks. A piece of music is composed of diverse kinds of tracks, so to say, the instruments such as drum, bass, piano, string, guitar, etc. Therefore, many kinds of tracks are prepared in a style where the user can add or delete the desired tracks.

The step S7 is for the modification of track accompaniment. Since there are various performance methods in same track, the user have many selections from the presented performance methods. For example, in case of correcting a drum track, various drum performances are presented, and then, once a desired performance is selected, the whole drum track is modified all over the music.

The step S8 is for the detailed modification of track accompaniment. Once the user clicks the desired part of each measure, the list of changeable music measures is presented, and the user can select a performance of the desired measure.

The step S9 is for modifying the tone-color of track. For example, even in the same string track, there are various kinds of the tone colors. As, in the elements of tone color, there is a variation of mixing (changing sounds by various effects to the instruments) as well as the change of a tone color, various sounds can be obtained by selecting the presented tone colors of the instruments without changing the performance of the whole music.

After modifying the track in this way, at the step S10, the user decides whether to make more revisions utilizing the professional functions; going to mark A for more modifications, otherwise, advancing to the step S14.

The step S11~S13 is for the modification of the composed music with professional musical knowledge or other instruments, which will be explained on FIG. 4.

At the step S14, the measures with melody matching with the composed accompaniment is presented one by one, and the user completes the music composition by combining into the desired melody.

The step S15 is about the patterned lyrics data which is stored in the lyrics database (112) of FIG. 2. The user writes the lyrics with reference to these patterned lyrics data, which are presented in accordance with genre, rhythm, and artist of the composed music after systematic classification by subject and purposes.

At the step S16, with the composed accompaniment and lyrics, the user can record a song through a mike installed in the user PC (110), or record any instrument or sound effect.

At the last step S17, the user finalizes the desired music by adjusting the volume of each track, panning (left/right/middle positioning), a tone, various effects, and the total volume.

FIG. 4 is for the advanced users capable of playing the instruments to modify the composed music utilizing professional function.

The step S11 refers to the method of the musical composition by connecting an additional USB keyboard and sound source (instrument) to the user PC (120) with various kinds of MIDI editor function. The user can record by playing the music personally without depending on the automatically presented patterned-data.

The step S12 is related to modifying the structure of music. The user can freely form the structure of music selected at the step S3 by adding and deleting the measures. For example, it is possible to modify the structure into the format such as prelude—introduction—2 measures added by the user—connection (4 measures added by the user).

At the step S13, after re-forming the measures in this way, the user modifies the codes of music by freely inputting the desired codes, instead of the defined codes which are automatically presented at the step S4 of FIG. 3.

The following steps (S14-S18) are the same as the process of FIG. 3.

FIG. 5 shows the user interface composing the music in pursuance of the operational flow chart of FIG. 3.

By clicking the genre-selecting button (501) with a mouse, the user selects a piece of music with a subdivided style of a genre.

At this point, the selected music is of the desired genre (large category)—the specified artist genre (small category)—a variation of music with a similar atmosphere; for example, subdivided format such as 'modern rock ballad—(○○○) ballad—rain ballad', and a piece of music is completely composed by simply selecting a style.

Pressing the structure button (511) shows the list of available structure within the selected style, and the user may listen to the sounds by positioning the mouse over it. Once a desired structure is selected, the structure of music, that is, only the flow is changed without the change of previously worked contents. Therefore, the previously composed music can be arranged in various ways, and easily modified, which is the important bases for composing a music (for example, prelude introduction—repetition of introduction—connection part—climax—interlude—connection part—climax—repetition of climax—postlude).

In addition, if the user clicks the code display part (510) at the top side of the desired measure of music, all the list of code progression referred to the structure group (climax/postlude/interlude, etc.) to which the measure belongs are presented, and the user may listen to the sounds by positioning the mouse over the list. Once a desired code is selected, all tracks of the measure are changed to the selected code.

By clicking the track button (502) is clicked, the user can see the list of additional instruments except a group of instruments (for example, each track is composed of drum, percussion, bass, keyboard, string, rap, sound effects, etc.) which is automatically made up when selecting a genre. Thus, the user selects necessary ones from the presented instruments, adds or deletes the tracks, and selects the kind of each track. In this way, the modification of a track can be executed as explained at the step S5-S9 of FIG. 3.

When clicking each track (512), the list of accompaniment of each track is presented. The user may listen to it by positioning the mouse over, and select a desired one to modify the accompaniment of the related track all over the music without changing the previously selected particulars.

If the tone color button (503) is selected, the list of exchangeable tone color is presented, and by selecting a desired tone color, all tone colors of the related track are changed. In this case, other elements of the previously composed music are not changed.

Furthermore, by using the tempo button (504) and the key button (505), the user modifies the tempo and code of music.

By clicking the melody button (506), the user can see the melody pattern matching with the measures which the user intends to modify, and may modify the melody pattern of each measure.

By clicking the space (507) of each measure, the user may modify the detailed elements of track accompaniment after listening to the sounds by positioning the mouse over the list presented when clicking each measure. Once a desired element is selected, only the related measure is changed into the selected pattern.

The progression bar (508) indicates the present progressing position (measure) and the code and track of each measure when the music is played, to make it easy to monitor the on-going status of music.

Besides, since the user may listen to all the data presented when clicking each button by positioning a mouse over, and the volume becomes low when the music is played in order to make it possible to monitor at the same time, the user can modify the music easily while taking the whole harmony into account.

The music composed as above is not stored yet, required for payment process by clicking the purchasing button (509) to link to a homepage on the Internet or to download to the user PC (120).

INDUSTRIAL APPLICABILITY

In the past, the musical compositions and the arrangements were made by only those who have special knowledge about music, but thanks to this invention, it becomes possible for the ordinary people having interest in music to compose his/her desired music without any difficulties.

Furthermore, since it becomes possible to compose music with his/her own PC through the Internet, the advantage of this invention is that it remarkably cut down the expenses of music production, and is totally free from time and space restrictions.

Finally, by using this invention, various changes and modifications can be made within the scope of the structure.

The invention claimed is:

1. A method of producing/composing music by using the internet wherein a plurality of user computer and a music production/composition system are connected to the Internet comprising, a step of patterning music by genre of music, artist, structure of music, rhythm, instrument, performance method, variation, mixing information, artist information, BPM, and code, patterning various kinds of texts by genre and rhythm, and storing them into the database, a step of allowing a user to select a user-selecting item from the database in which the patterned music and lyrics data are stored, creating an accompaniment and basic track corresponding to the selected item, and playing it for the user, a step of allowing a user to select an item which the user intends to change in the structure, key, and tempo of music, so that a pattern suitable for the selected item is automatically searched and presented, and if the user selects the said presented pattern, the whole music is modified, a step of allowing a user to select an item which the user intends to change in order to modify the performance method and tone color of each track, so that a pattern suitable for the selected item is automatically searched and presented, and if the user selects the said presented pattern, the whole track is modified, a step of allowing a user to select an item which the user intends to change in order to modify the code of each measure, so that a pattern suitable for the selected item is automatically searched and presented, and if the user selects the said presented pattern, the whole measure is modified, a step of allowing a user to select an item which the user intends to change in order to modify the performance variation of each measure of each track, so that a pattern suitable for the selected item is automatically searched and presented, and if the user selects the said presented pattern, the corresponding measure is modified, a step of writing lyrics with reference to the patterned lyrics data which are presented from the database in accordance with the item the user selects, and a step of recording the completed accompaniment and lyrics on the said user PC.

2. A method of producing/composing music set forth in the claim 1 characterized by including an additional step of allowing a user to select a professional/advanced function and to modify the defined patterned data which is automatically presented from the database at the user's disposition.

3. A method of producing/composing music set forth in the claim 1, wherein the said user-selecting item presents at least genre of music, structure of music, rhythm, instrument, performance method, variation, code, and tempo.

* * * * *